US006380829B1

(12) United States Patent
Castonguay et al.

(10) Patent No.: US 6,380,829 B1
(45) Date of Patent: Apr. 30, 2002

(54) MOTOR OPERATOR INTERLOCK AND METHOD FOR CIRCUIT BREAKERS

(75) Inventors: Roger Neil Castonguay, Terryville; Dave Christensen, Harwinton, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/717,610

(22) Filed: Nov. 21, 2000

(51) Int. Cl.[7] ..... H01H 3/00
(52) U.S. Cl. ..... 335/68; 335/172
(58) Field of Search ..... 335/8–10, 68–74, 335/167–176, 202; 200/293–312

(56) References Cited

U.S. PATENT DOCUMENTS

| | | | | |
|---|---|---|---|---|
| 2,340,682 | A | | 2/1944 | Powell |
| 2,719,203 | A | | 9/1955 | Gelzheiser et al. |
| 2,937,254 | A | | 5/1960 | Ericson |
| 3,158,717 | A | | 11/1964 | Jencks et al. |
| 3,162,739 | A | | 12/1964 | Klein et al. |
| 3,197,582 | A | | 7/1965 | Norden |
| 3,307,002 | A | | 2/1967 | Cooper |
| 3,517,356 | A | | 6/1970 | Hanafusa |
| 3,631,369 | A | | 12/1971 | Menocal |
| 3,803,455 | A | | 4/1974 | Willard |
| 3,883,781 | A | | 5/1975 | Cotton |
| 4,001,739 | A | * | 1/1977 | Powell et al. ..... 335/18 |
| 4,129,762 | A | | 12/1978 | Bruchet |
| 4,144,513 | A | | 3/1979 | Shafer et al. |
| 4,158,119 | A | | 6/1979 | Krakik |
| 4,165,453 | A | | 8/1979 | Hennemann |
| 4,166,988 | A | | 9/1979 | Ciarcia et al. |
| 4,220,934 | A | | 9/1980 | Wafer et al. |
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |

(List continued on next page.)

*Primary Examiner*—Lincoln Donovan
*Assistant Examiner*—Tuyen Nguyen
(74) *Attorney, Agent, or Firm*—Cantor Colburn LLP

(57) ABSTRACT

An operating mechanism comprises an operating handle movable between on and off positions, the operating handle extending substantially up at a point between said on and off positions; a crank for controlling a contact arm of a circuit breaker to cause the contact arm to move between open and closed positions when the crank moved; mechanism springs connected between the operating handle and crank so that the crank moves when the mechanism springs are discharged and when the operating handle is moved between on and off positions; a trip latch restraining the mechanism springs from discharging unless moved; and a trip lever having a lever arm, the trip lever being biased by a tripping spring to cause the trip lever to extend substantially up from the operating mechanism and move the trip latch and discharge said mechanism springs unless the trip lever is prevented from rotating under the influence of said tripping spring.

8 Claims, 13 Drawing Sheets

U.S. PATENT DOCUMENTS

| | | | |
|---|---|---|---|
| 4,435,690 | A | 3/1984 | Link et al. |
| 4,467,297 | A | 8/1984 | Boichot-Castagne et al. |
| 4,468,645 | A | 8/1984 | Gerbert-Gaillard et al. |
| 4,470,027 | A | 9/1984 | Link et al. |
| 4,479,143 | A | 10/1984 | Watanabe et al. |
| 4,488,133 | A | 12/1984 | McClellan et al. |
| 4,492,941 | A | 1/1985 | Nagel |
| 4,541,032 | A | 9/1985 | Schwab |
| 4,546,224 | A | 10/1985 | Mostosi |
| 4,550,360 | A | 10/1985 | Dougherty |
| 4,562,419 | A | 12/1985 | Preuss et al. |
| 4,589,052 | A | 5/1986 | Dougherty |
| 4,595,812 | A | 6/1986 | Tamaru et al. |
| 4,611,187 | A | 9/1986 | Banfi |
| 4,612,430 | A | 9/1986 | Sloan et al. |
| 4,616,198 | A | 10/1986 | Pardini |
| 4,622,444 | A | 11/1986 | Kandatsu et al. |
| 4,631,625 | A | 12/1986 | Alexander et al. |
| 4,642,431 | A | 2/1987 | Tedesco et al. |
| 4,644,438 | A | 2/1987 | Puccinelli et al. |
| 4,649,247 | A | 3/1987 | Preuss et al. |
| 4,658,322 | A | 4/1987 | Rivera |
| 4,672,501 | A | 6/1987 | Bilac et al. |
| 4,675,481 | A | 6/1987 | Markowski et al. |
| 4,682,264 | A | 7/1987 | Demeyer |
| 4,689,712 | A | 8/1987 | Demeyer |
| 4,694,373 | A | 9/1987 | Demeyer |
| 4,710,845 | A | 12/1987 | Demeyer |
| 4,717,985 | A | 1/1988 | Demeyer |
| 4,733,211 | A | 3/1988 | Castonguay et al. |
| 4,733,321 | A | 3/1988 | Lindeperg |
| 4,764,650 | A | 8/1988 | Bur et al. |
| 4,768,007 | A | 8/1988 | Mertz et al. |
| 4,780,786 | A | 10/1988 | Weynachter et al. |
| 4,831,221 | A | 5/1989 | Yu et al. |
| 4,870,531 | A | 9/1989 | Danek |
| 4,883,931 | A | 11/1989 | Batteux et al. |
| 4,884,047 | A | 11/1989 | Baginski et al. |
| 4,884,164 | A | 11/1989 | Dziura et al. |
| 4,900,882 | A | 2/1990 | Bernard et al. |
| 4,910,485 | A | 3/1990 | Bolongeat-Mobleu et al. |
| 4,914,541 | A | 4/1990 | Tripodi et al. |
| 4,916,420 | A | 4/1990 | Bartolo et al. |
| 4,916,421 | A | 4/1990 | Pardini et al. |
| 4,926,282 | A | 5/1990 | McGhie |
| 4,935,590 | A | 6/1990 | Malkin et al. |
| 4,937,706 | A | 6/1990 | Schueller et al. |
| 4,939,492 | A | 7/1990 | Raso et al. |
| 4,943,691 | A | 7/1990 | Mertz et al. |
| 4,943,888 | A | 7/1990 | Jacob et al. |
| 4,950,855 | A | 8/1990 | Bolonegeat-Mobleu et al. |
| 4,951,019 | A | 8/1990 | Gula |
| 4,952,897 | A | 8/1990 | Barnel et al. |
| 4,958,135 | A | 9/1990 | Baginski et al. |
| 4,965,543 | A | 10/1990 | Batteux |
| 4,983,788 | A | 1/1991 | Pardini |
| 5,001,313 | A | 3/1991 | Leclerq et al. |
| 5,004,878 | A | 4/1991 | Seymour et al. |
| 5,029,301 | A | 7/1991 | Nebon et al. |
| 5,030,804 | A | 7/1991 | Abri |
| 5,057,655 | A | 10/1991 | Kersusan et al. |
| 5,077,627 | A | 12/1991 | Fraisse |
| 5,083,081 | A | 1/1992 | Barrault et al. |
| 5,095,183 | A | 3/1992 | Raphard et al. |
| 5,103,198 | A | 4/1992 | Morel et al. |
| 5,115,371 | A | 5/1992 | Tripodi |
| 5,120,921 | A | 6/1992 | DiMarco et al. |
| 5,132,865 | A | 7/1992 | Mertz et al. |
| 5,138,121 | A | 8/1992 | Streich et al. |
| 5,140,115 | A | 8/1992 | Morris |
| 5,153,802 | A | 10/1992 | Mertz et al. |
| 5,155,315 | A | 10/1992 | Malkin et al. |
| 5,166,483 | A | 11/1992 | Kersusan et al. |
| 5,172,087 | A | 12/1992 | Castonguay et al. |
| 5,178,504 | A | 1/1993 | Falchi |
| 5,184,717 | A | 2/1993 | Chou et al. |
| 5,187,339 | A | 2/1993 | Lissandrin |
| 5,198,956 | A | 3/1993 | Dvorak |
| 5,200,724 | A | 4/1993 | Gula et al. |
| 5,210,385 | A | 5/1993 | Morel et al. |
| 5,239,150 | A | 8/1993 | Bolongeat-Mobleu et al. |
| 5,260,533 | A | 11/1993 | Livesey et al. |
| 5,262,744 | A | 11/1993 | Arnold et al. |
| 5,280,144 | A | 1/1994 | Bolongeat-Mobleu et al. |
| 5,281,776 | A | 1/1994 | Morel et al. |
| 5,296,600 | A | 3/1994 | Morel et al. |
| 5,296,664 | A | 3/1994 | Crookston et al. |
| 5,298,874 | A | 3/1994 | Morel et al. |
| 5,300,907 | A | 4/1994 | Nereau et al. |
| 5,310,971 | A | 5/1994 | Vial et al. |
| 5,313,180 | A | 5/1994 | Vial et al. |
| 5,317,471 | A | 5/1994 | Izoard et al. |
| 5,323,131 | A | 6/1994 | Castonguay |
| 5,331,500 | A | 7/1994 | Corcoles et al. |
| 5,334,808 | A | 8/1994 | Bur et al. |
| 5,341,191 | A | 8/1994 | Crookston et al. |
| 5,347,096 | A | 9/1994 | Bolongeat-Mobleu et al. |
| 5,347,097 | A | 9/1994 | Bolongeat-Mobleu et al. |
| 5,350,892 | A | 9/1994 | Rozier |
| 5,357,066 | A | 10/1994 | Morel et al. |
| 5,357,068 | A | 10/1994 | Rozier |
| 5,357,394 | A | 10/1994 | Piney |
| 5,361,052 | A | 11/1994 | Ferullo et al. |
| 5,373,130 | A | 12/1994 | Barrault et al. |
| 5,379,013 | A | 1/1995 | Coudert |
| 5,424,701 | A | 6/1995 | Castonguary et al. |
| 5,438,176 | A | 8/1995 | Bonnardel et al. |
| 5,440,088 | A | 8/1995 | Coudert et al. |
| 5,449,871 | A | 9/1995 | Batteux et al. |
| 5,450,048 | A | 9/1995 | Leger et al. |
| 5,451,729 | A | 9/1995 | Onderka et al. |
| 5,457,295 | A | 10/1995 | Tanibe et al. |
| 5,467,069 | A | 11/1995 | Payet-Burin et al. |
| 5,469,121 | A | 11/1995 | Payet-Burin |
| 5,475,558 | A | 12/1995 | Barjonnet et al. |
| 5,477,016 | A | 12/1995 | Baginski et al. |
| 5,479,143 | A | 12/1995 | Payet-Burin |
| 5,483,212 | A | 1/1996 | Lankuttis et al. |
| 5,485,343 | A | 1/1996 | Santos et al. |
| D367,265 | S | 2/1996 | Yamagata et al. |
| 5,493,083 | A | 2/1996 | Olivier |
| 5,504,284 | A | 4/1996 | Lazareth et al. |
| 5,504,290 | A | 4/1996 | Baginski et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |
| 6,194,983 | B1 * | 2/2001 | Bogdon et al. ..... 335/68 |

FOREIGN PATENT DOCUMENTS

| | | | |
|---|---|---|---|
| DE | 38 02 184 | | 8/1989 |
| DE | 38 43 277 | | 6/1990 |
| DE | 0 612 092 | A1 | 2/1994 |
| DE | 44 19 240 | | 1/1995 |
| EP | 0 061 092 | | 9/1982 |
| EP | 0 064 906 | | 11/1982 |
| EP | 0 066 486 | | 12/1982 |
| EP | 0 076 719 | | 4/1983 |
| EP | 0 117 094 | | 8/1984 |
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 310 | | 1/1991 |
| EP | 0 452 230 | | 10/1991 |
| EP | 0 555 158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 700 140 | | 3/1996 |
| EP | 0 889 498 | | 1/1999 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| JP | 10-223117 | * | 5/1998 |
| WO | 92/00598 | | 1/1992 |
| WO | 92/05649 | | 4/1992 |
| WO | 94/00901 | | 1/1994 |

* cited by examiner

MOTOR OPERATOR INTERLOCK AND METHOD FOR CIRCUIT BREAKERS

BACKGROUND OF THE INVENTION

The present invention is directed to circuit breakers, and more particularly to interlock mechanisms to trip the circuit breaker when a motor operator is separated therefrom.

Circuit breakers include movable and fixed contacts for opening and closing the distribution circuit and an operating handle for manually operating the contacts. In some installations of industrial rated molded-case circuit breakers, it is convenient or necessary to install a motor operator allowing remote operation the circuit breaker. For example, remote operation may be desired when the circuit breaker is located remote from associated equipment. Motor operators mount directly on the circuit breaker and include a chuck or drive slide that engages the manual operating handle, and moves the operating handle under force of some actuating mechanism within the motor operator housing.

Prior art motor operators include a blocking arrangement to prevent closure or installation of the motor operator when the circuit breaker operating handle is out of alignment with the motor operator. A drawback of this blocking arrangement has been a potential for damage to the motor operator if a person applies excessive force attempting to close the motor operator when the operating handle and operator chuck are out of alignment.

BRIEF SUMMARY OF THE INVENTION

The above discussed and other drawbacks and deficiencies are overcome or alleviated by an operating mechanism comprising an operating handle movable between on and off positions, the operating handle extending substantially up at a point between said on and off positions; a crank for controlling a contact arm of a circuit breaker to cause the contact arm to move between open and closed positions when the crank moves; mechanism springs connected between the operating handle and crank so that the crank moves when the mechanism springs are discharged and when the operating handle is moved between on and off positions; a trip latch restraining the mechanism springs from discharging unless moved; and a trip lever having a lever arm, the trip lever being biased by a tripping spring to cause the trip lever to extend substantially up from the operating mechanism and move the trip latch and discharge said mechanism springs unless the trip lever is prevented from rotating under the influence of said tripping spring.

The above-discussed and other features and advantages of the present invention will be appreciated and understood by those skilled in the art from the following detailed description and drawings.

BRIEF DESCRIPTION OF THE DRAWINGS

Referring to the Figures wherein like elements are numbered alike in the several Figures

DETAILED DESCRIPTION OF THE INVENTION

Figure 1:
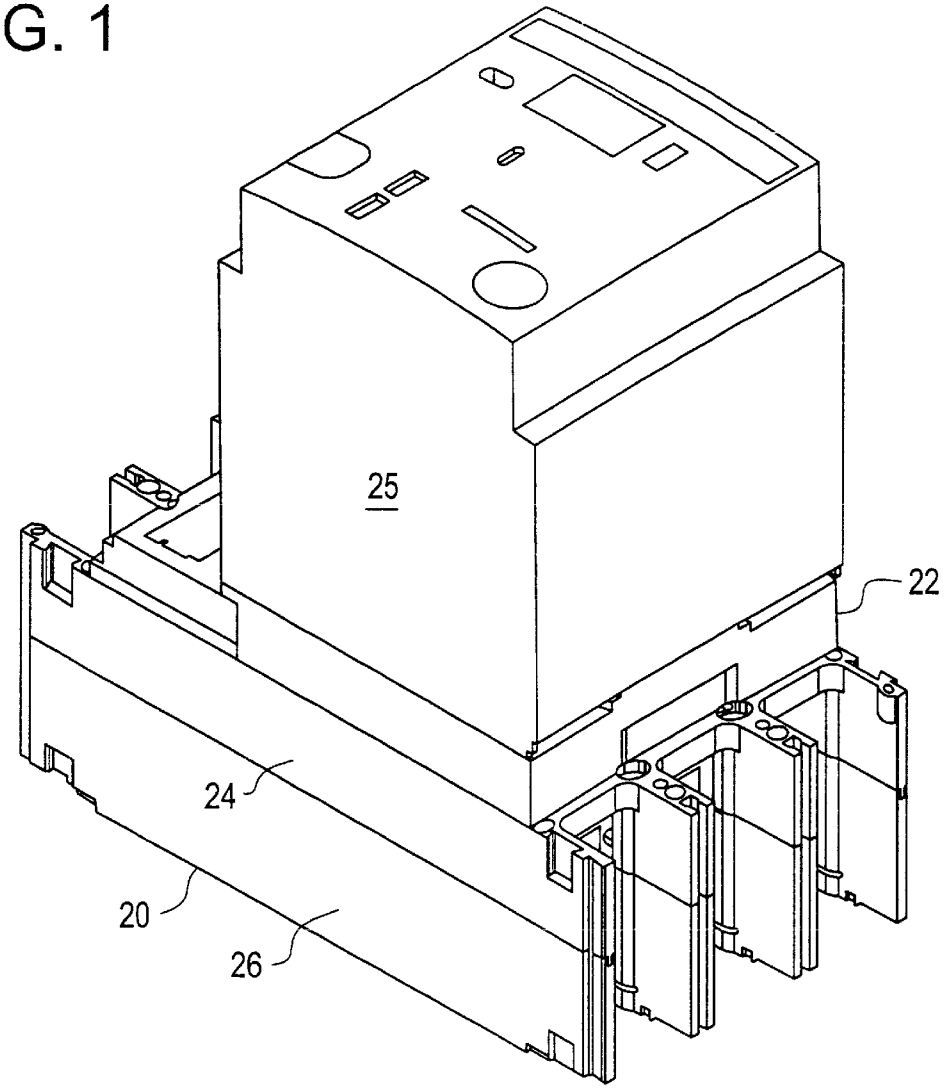
FIG. 1 is an isometric view of an industrial-rated molded case circuit breaker with a motor operator installed thereon.
Figure 2:
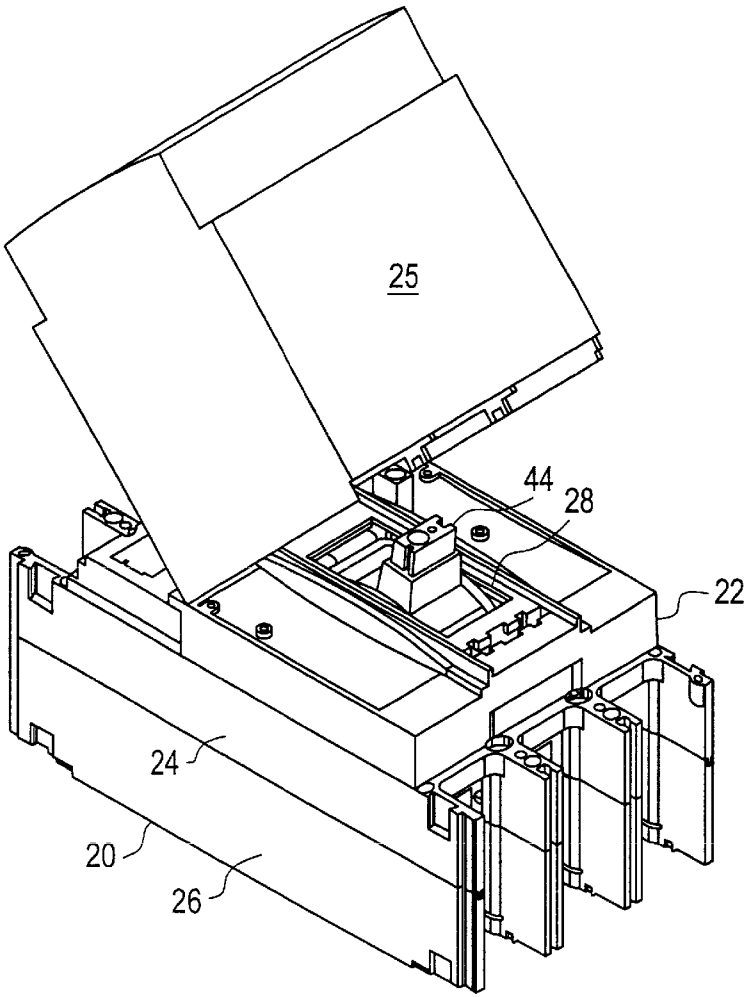
FIG. 2 is an isometric view of the industrial-rated molded case circuit breaker of FIG. 1 with the motor operator rotated out of engagement with the operating handle of the circuit breaker.
Figure 3:
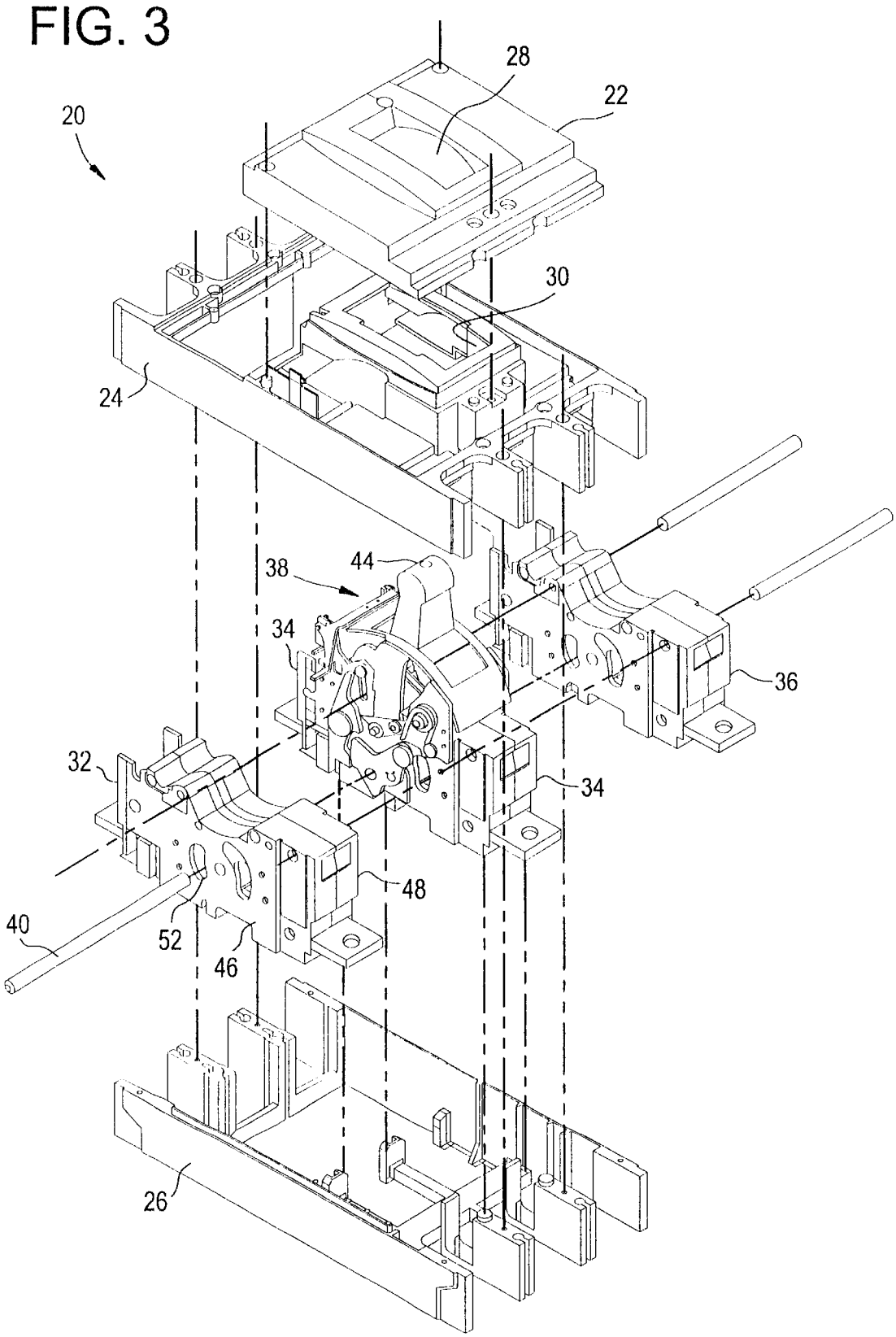
FIG. 3 is an exploded view of the circuit breaker of FIG. 1.
Figure 16:
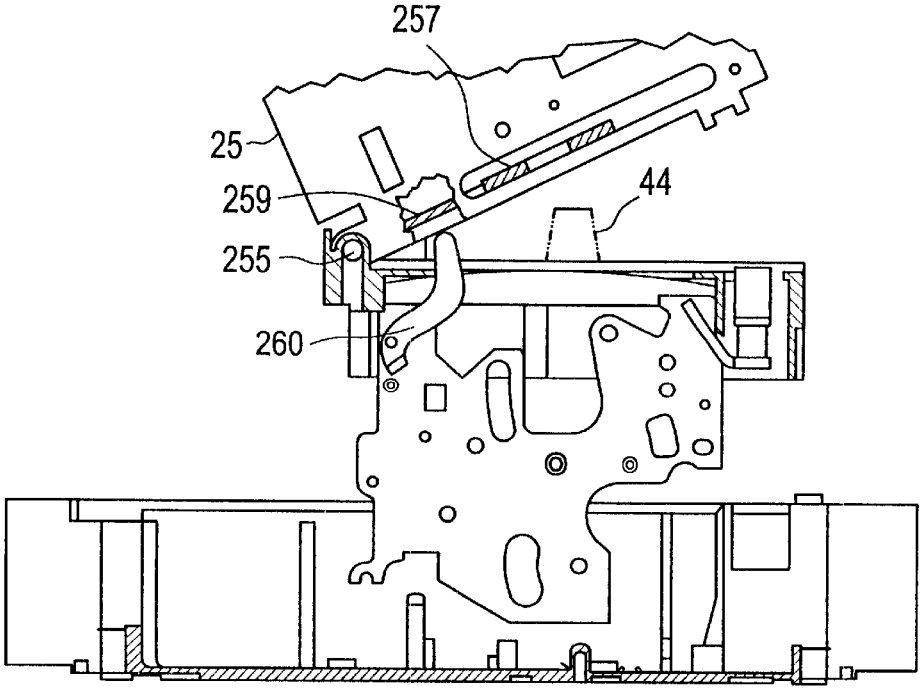
FIG. 16 is a partial view of the motor operator installed on the circuit breaker, showing the interaction between the motor operator and interlock mechanism.

FIGS. 1 and 2 show a circuit breaker 20 with motor operator 25. Reference will also be made to FIG. 3, showing a partially exploded view of circuit breaker 20. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another. Motor operator 25 is connected to circuit breaker 20 via a hinge 255 (FIG. 16).

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly."

An operating handle 44 extends through openings 28 and 30 and allows for external operation of cassettes 32, 34 and 36. Examples of rotary contact structures that may be operated by operating mechanism 38 are described in more detail in U.S. patent application Ser. No. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters." Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 4:
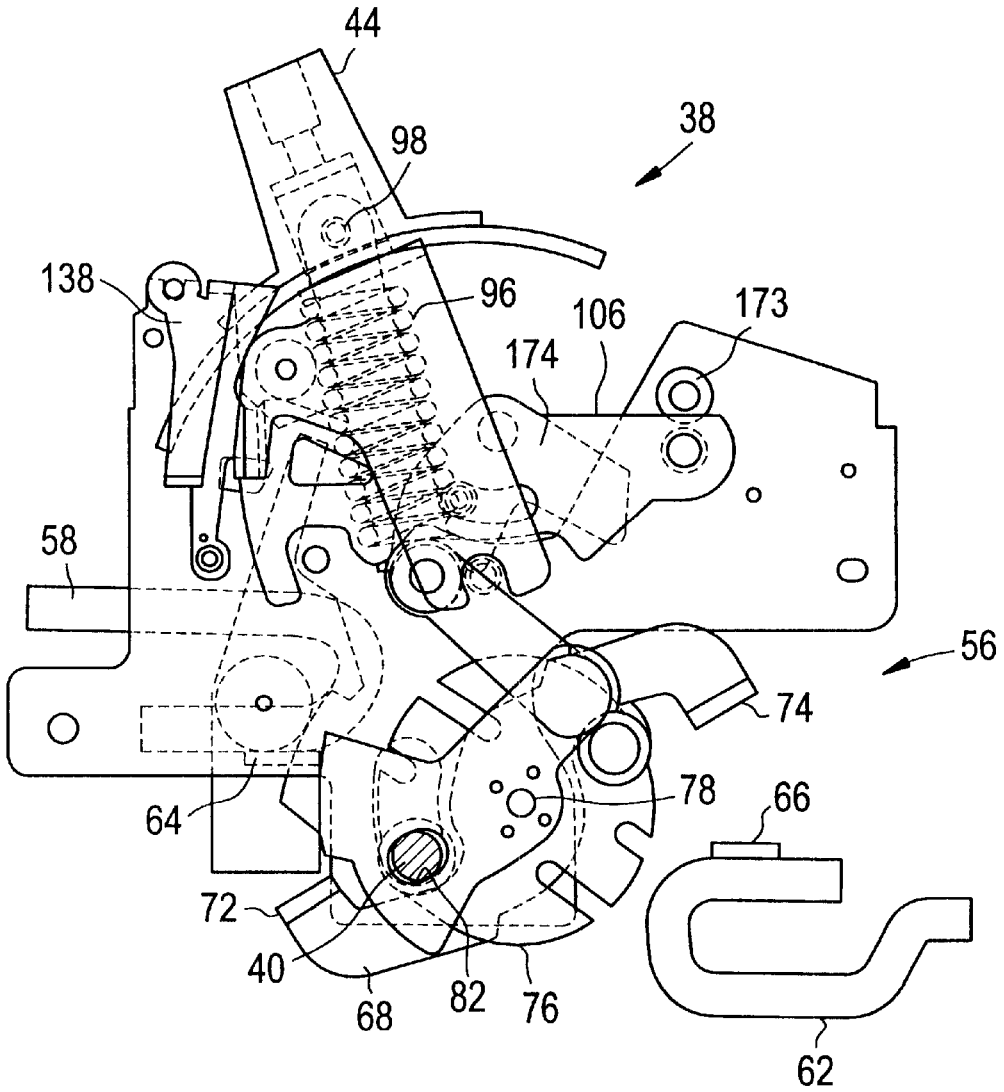
FIG. 4 is a partial sectional view of a rotary contact structure and operating mechanism in the "off" position.
Figure 5:
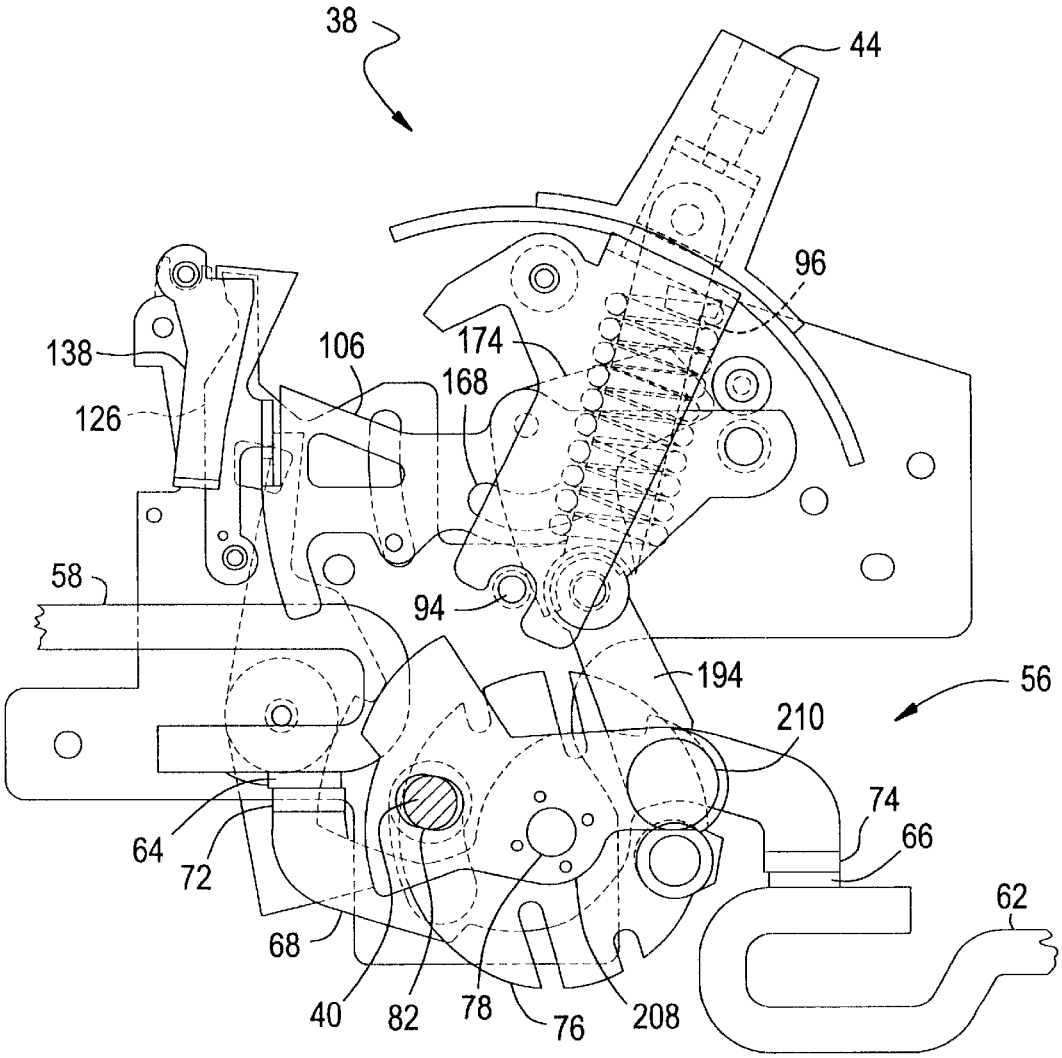
FIG. 5 is a partial sectional view of the rotary contact structure and operating mechanism of FIG. 4 in the "on" position.
Figure 6:
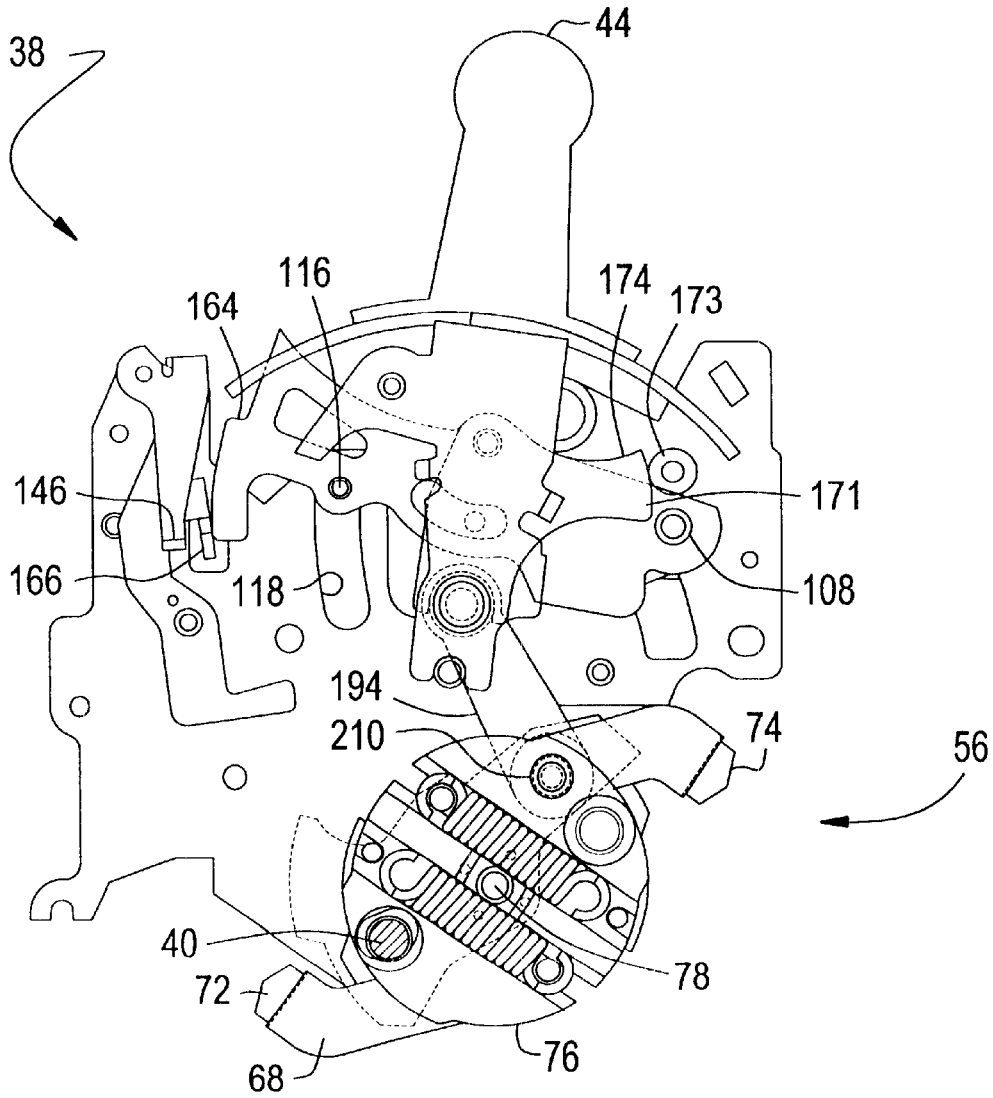
FIG. 6 is a partial sectional view of the rotary contact structure and operating mechanism of FIGS. 4 and 5 in the "tripped" position.

Referring now to FIGS. 4, 5, and 6, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection to a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 4) of operating mechanism 38, wherein operating handle 44 is oriented to the left (e.g., via a manual or mechanical force), contacts 72 and 74 are separated from stationary contacts 64 and 66, thereby preventing current from flowing through contact arm 68. It should be appreciated that while rotary contact assembly 56 shows a contact arm having a pair of movable contacts, rotary contact assemblies wherein the contact arm has only a single movable contact is contemplated.

In the "on" position of operating mechanism 38 shown in FIG. 5, wherein operating handle 44 is oriented to the right as depicted in FIG. 5 (e.g., via a manual or mechanical force), contacts 72 and 74 are mated with stationary contacts 64 and 66, thereby allowing current to flow through contact arm 68. In the "tripped" position shown in FIG. 6, operating handle 44 is oriented between the "on" position and the "off" positions (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move operating handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 7:
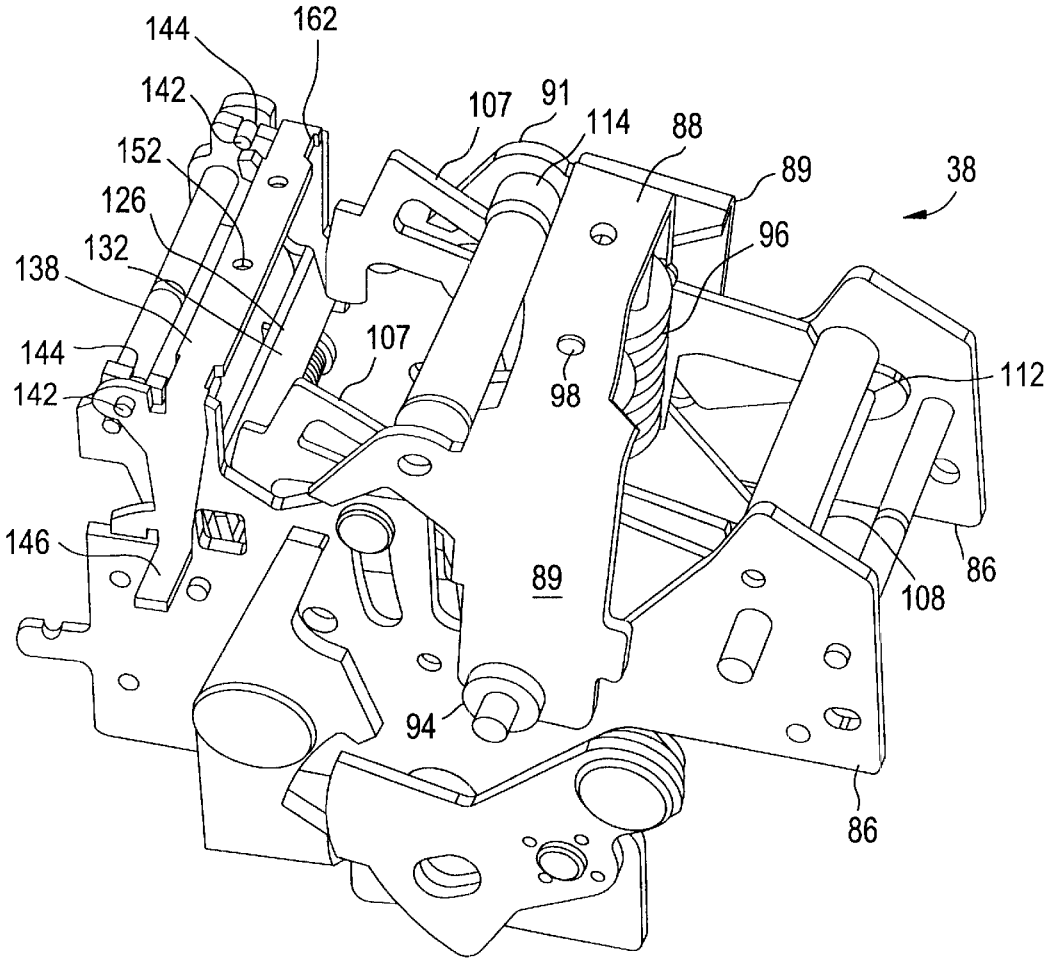
FIG. 7 is an isometric view of the operating mechanism.
Figure 8:
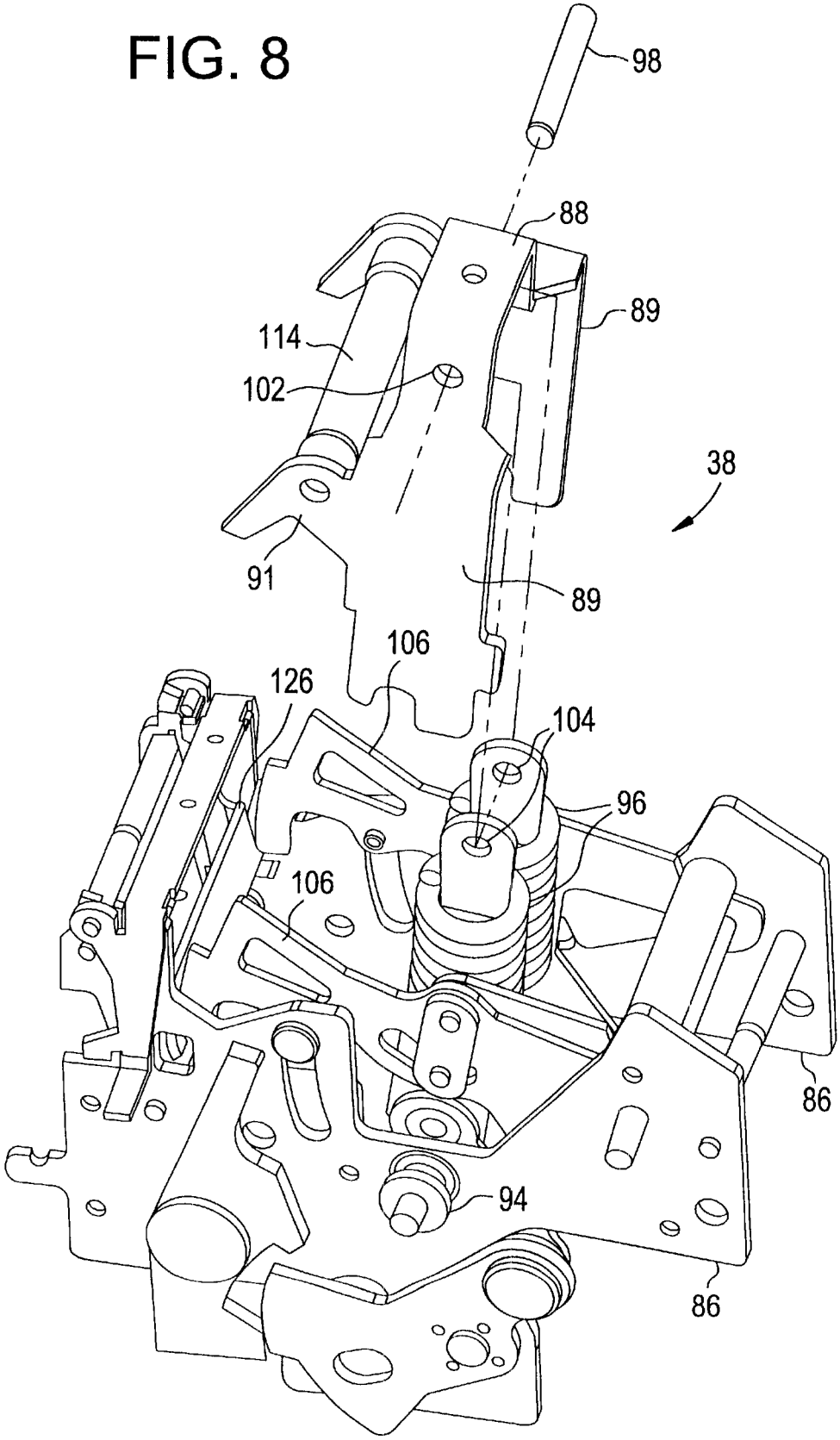
FIG. 8 is a partially exploded view of the operating mechanism.
Figure 9:
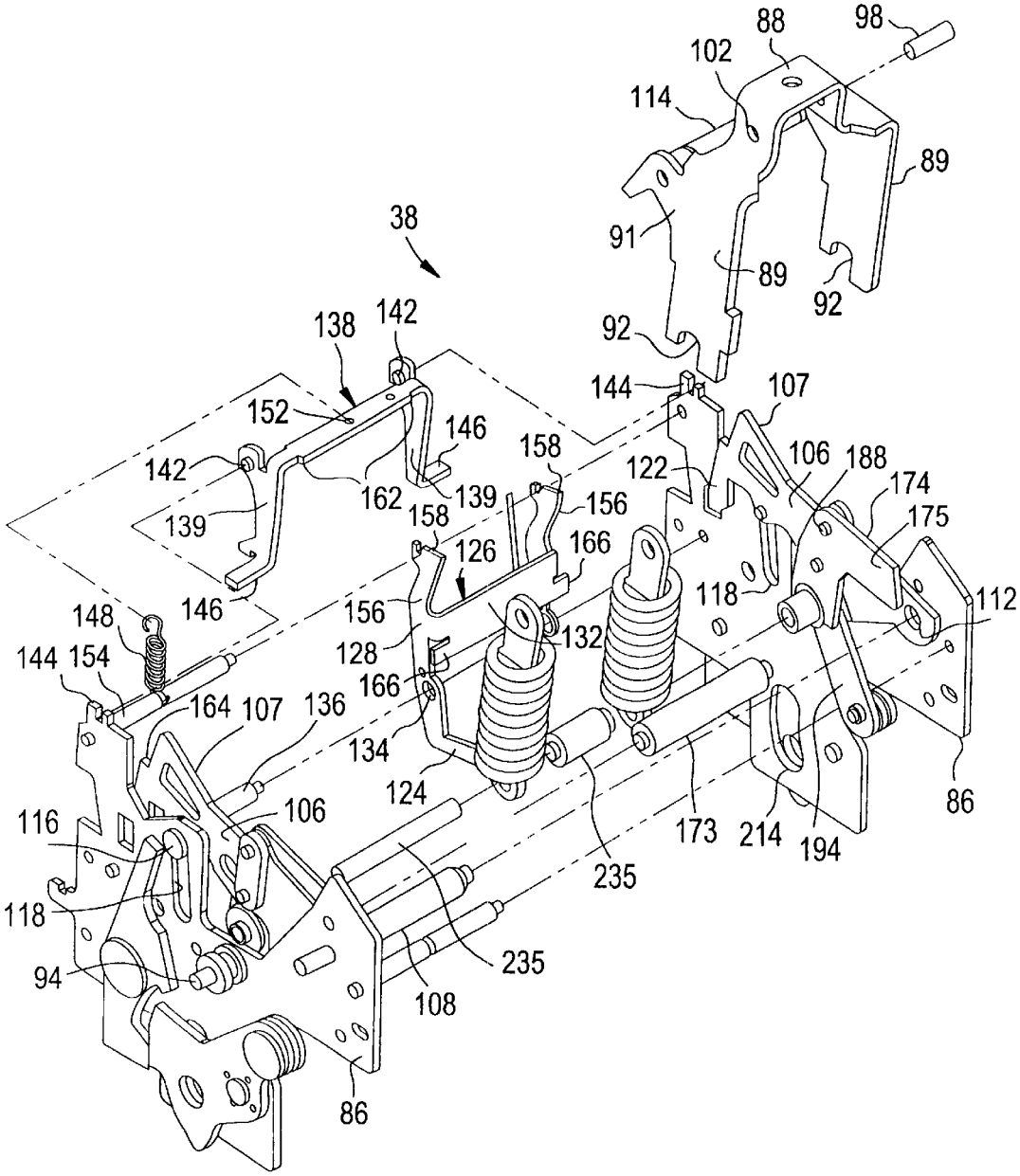
FIG. 9 is another partially exploded view of the operating mechanism.

Referring now to FIGS. 7–9, the components of operating mechanism 38 will now be detailed. As viewed in FIGS. 7–9, operating mechanism 38 is in the "tripped" position. Operating mechanism 38 has operating mechanism side frames 86 configured and positioned to straddle sidewalls 46, 48 of cassette 34 (FIG. 3).

Operating handle 44 (FIG. 3) is rigidly interconnected with a drive member or handle yoke 88. Handle yoke 88 includes opposing side portions 89. Each side portion 89 includes an extension 91 at the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 10:
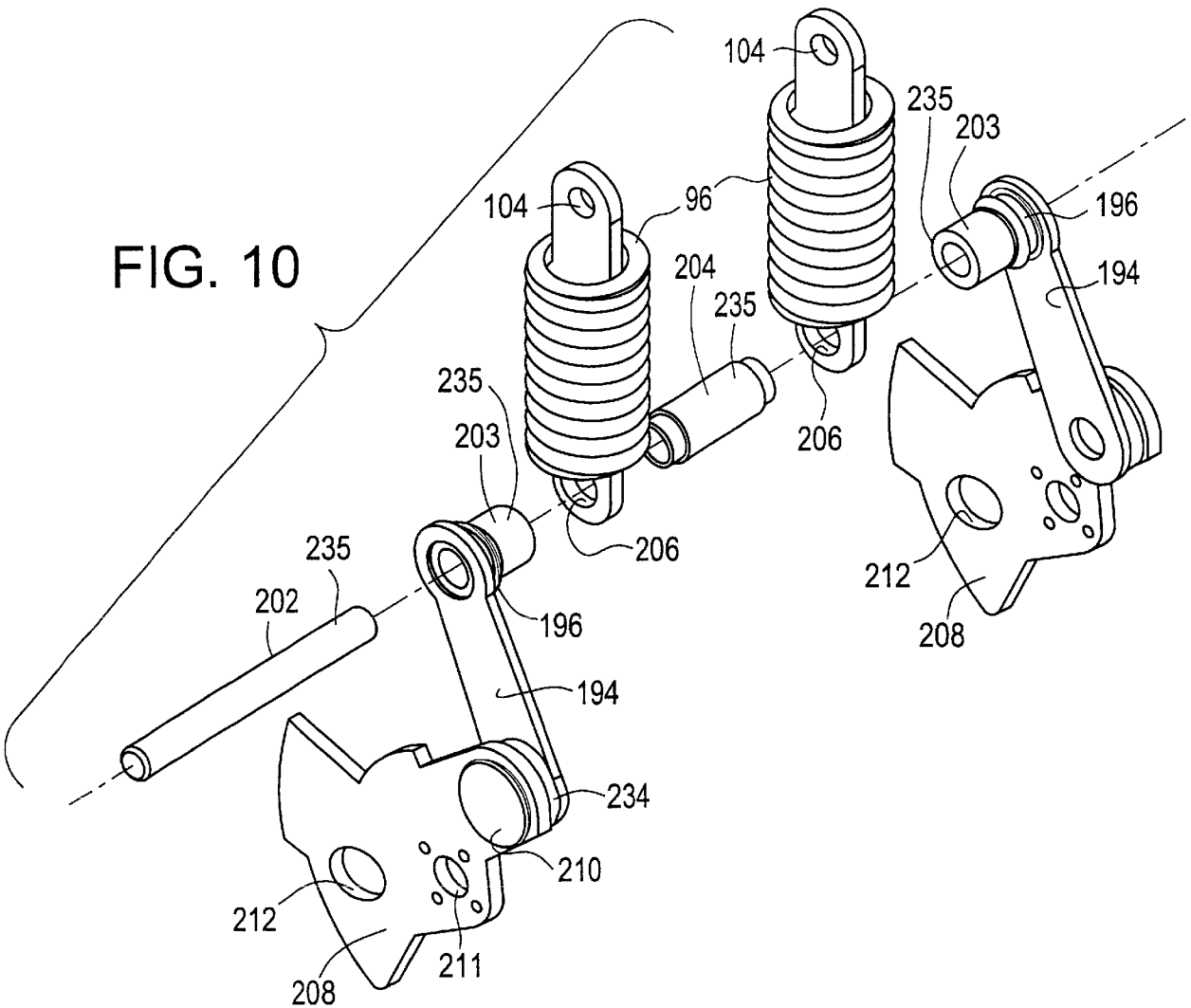
FIG. 10 is an exploded view of a pair of mechanism springs and associated linkage components within the operating mechanism.

Referring to FIG. 10, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 12:
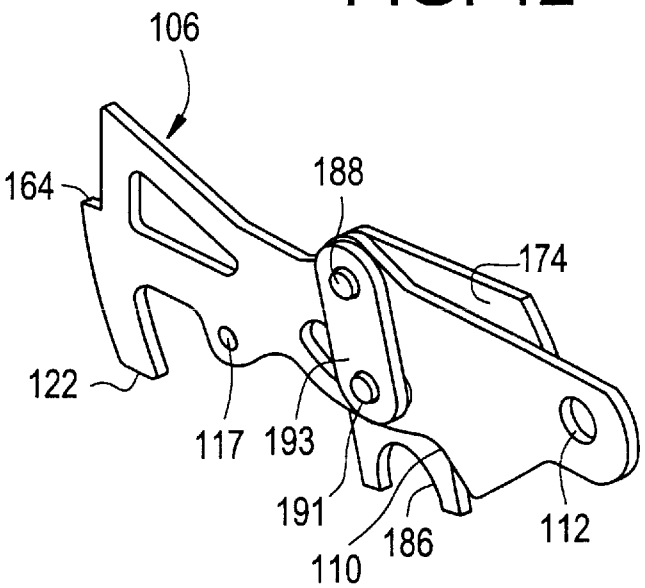
FIGS. 11 and 12 are an isometric and exploded view, respectively, of linkage components within the operating mechanism.
Figure 11:
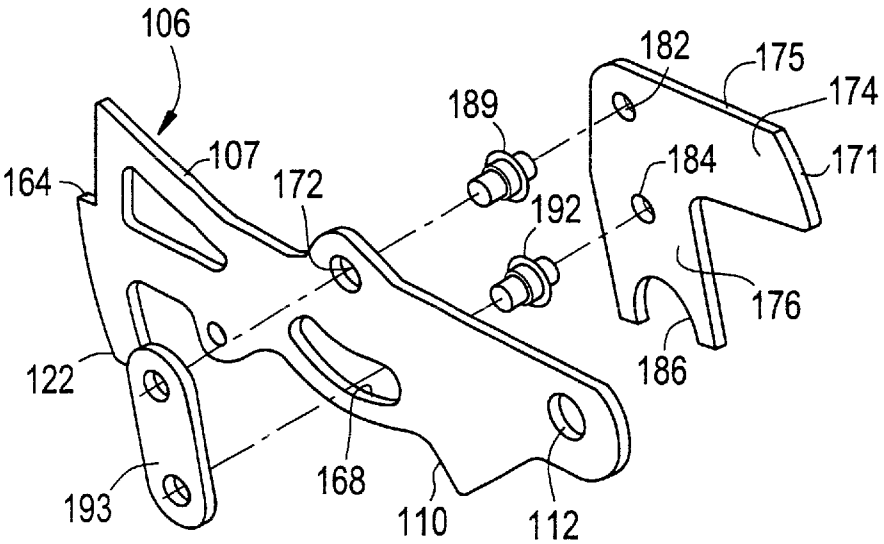

Referring to FIGS. 9, 11, and 12, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. Each cradle 106 also includes a stop surface 110 formed thereon. A rivet 116 disposed through an arcuate slot 118 within each side frame 86, as best seen in FIGS. 6 and 9, guides the movement of each cradle 106. Rivets 116 are disposed within an opening 117 on each cradle 106 (FIG. 12). An arcuate slot 168 is positioned intermediate to opening 112 and opening 117 on each cradle 106. An opening 172 is positioned above slot 168.

Referring back to FIGS. 7–9, a primary latch 126 is positioned within side frames 86. Primary latch 126 includes a pair of side portions 128 (FIG. 9). Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that a primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes legs 139 each having a secondary latch trip tab 146 that extends perpendicularly from operating mechanism 38. Secondary latch 138 includes a set of latch surfaces 162, that align with primary latch surfaces 158.

Secondary latch 138 is biased in the clockwise direction due to the pulling forces of a spring 148 (FIG. 9). Spring 148 has a first end connected at an opening 152 upon secondary latch 138, and a second end connected at a frame cross pin 154 disposed between frames 86.

A set of upper links 174 are connected to cradles 106. Upper links 174 generally have a right angle shape, as best viewed in FIGS. 9 and 11. Legs 175 (in a substantially horizontal configuration in FIG. 11) of upper links 174 each have a cam portion 171 that interfaces a roller 173 disposed between frames 86 (FIG. 9). Legs 176 (in a substantially vertical configuration in FIGS. 9 and 11) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 (FIG. 12) both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Upper links 174 are each interconnected with a lower link 194. Referring now to FIGS. 9 and 10, U-shaped portion 186 of each upper link 174 is disposed in a complementary set of bearing washers 196. Bearing washers 196 are arranged on each side tube 203. Bearing washers 196 are configured to include side walls spaced apart sufficiently so that U-shaped portions 186 of upper links 174 fit in bearing washer 196. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls of bearing washer 196), lower link 194 and mechanism springs 96.

Each lower link 194 is interconnected with a crank 208 via a pivotal rivet 210. Each crank 208 pivots about a center 211. Crank 208 has an opening 212 where cross pin 40 (FIG. 2) passes through into arcuate slot 52 of cassettes 32, 34 and 36 and a complementary set of arcuate slots 214 on each side frame 86 (FIG. 9).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Referring back to FIGS. 4–6, the movement of operating mechanism 38 relative to rotary contact assembly 56 will be detailed.

Referring to FIG. 4, in the "off" position operating handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 4–6). Cam surface 171 of upper link 174 is out of contact with roller 173.

Referring now to FIG. 5, a manual closing force was applied to operating handle 44 to move it from the "off" position (i.e., FIG. 4) to the "on" position (i.e., to the right as oriented in FIG. 5). While the closing force is applied, upper links 174 rotate within arcuate slots 168 of cradles 106 about pins 188, and lower link 194 is driven to the right under bias of the mechanism spring 96. Side walls of bearing washers 196 maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to operating handle 44 to change from the "off" position to the "on" position.

Referring now to FIG. 6, in the "tripped" condition, secondary latch trip tab 146 has been displaced, e.g., by the motor operator interlock, described in detail below, and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188, 191 to upper link 174 having cam surface 171. After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210) causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

Referring now to FIGS. 13–16, the motor operator interlock mechanism 250 will be described in detail. Motor operator interlock mechanism 250 includes a trip lever 260 preferably assembled to side frame 86 as shown. Trip lever 260, shown in FIGS. 13 and 14 in a depressed state, is pivotally retained to side frame 86 by bushings 270 and 280 which are riveted to side frame 86 by a pin 285. Trip lever 260 includes a lever arm 263 and extension 267. Lever arm 263 has a bend in it so that a substantially vertical force represented by arrow 262 (FIG. 13) will depress trip lever 260 as shown. Extension 267 includes a bent-in portion in proximity with leg 139 of secondary latch 138.

Figure 13:
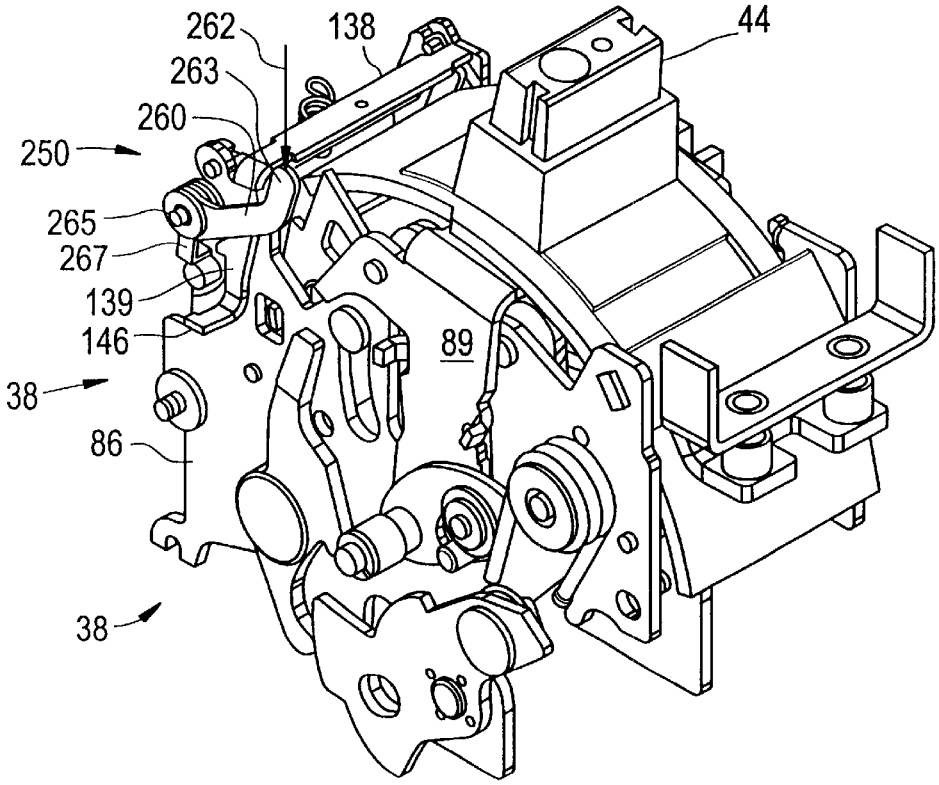
FIG. 13 is an isometric view of the operating mechanism with the motor operator interlock installed.
Figure 14:
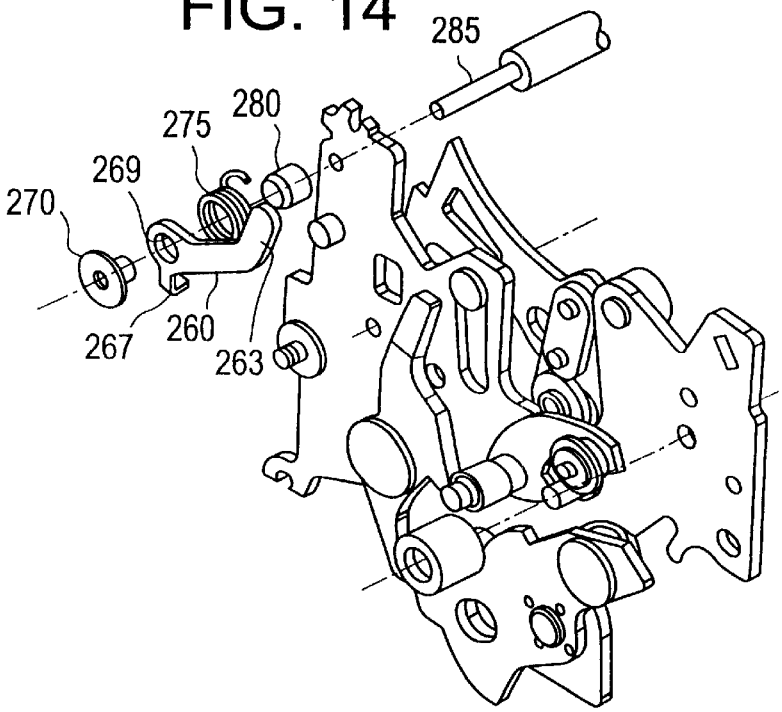
FIG. 14 is a detailed partially-exploded view showing the components of the motor operator interlock in relation to the operating mechanism.

A tripping spring 275 is captured in a manner to bias trip liver 260 in a clockwise direction as shown in FIGS. 13 and 14. When trip lever 260 rotates counter clockwise under the influence of tripping spring 275, extension 267 engages leg 139 of secondary latch 138, forcing secondary latch 138 to rotate, releasing primary latch 126, causing operating mechanism 38 and circuit breaker 20 to trip as previously described.

Figure 15:
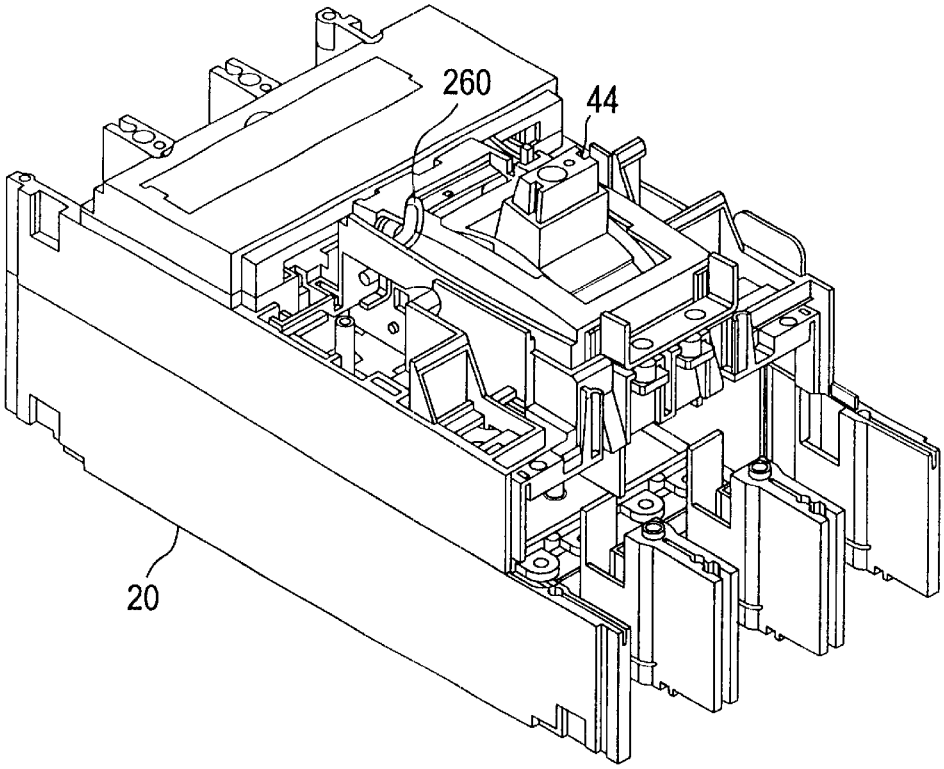
FIG. 15 is an isometric view of the circuit breaker with the top cover removed showing portions of the motor operator interlock.

FIG. 15 shows circuit breaker 20 with top cover 24 (FIG. 3) removed, allowing lever arm 263 to extend under the influence of tripping spring 275 as described above. When operating mechanism 38 trips, operating handle 44 rotates under the bias of mechanism springs to the tripped position shown.

FIG. 16 makes clear the interaction of trip arm 260 and motor operator 25. Motor controller positions a driver such as a drive slide 257 into alignment with the trip position of the operating handle upon disengagement with the operating handle. Therefore, as long as operating handle 44 is in the tripped position shown in FIG. 16, drive slide 257 of motor operator 25 will be properly aligned with handle 44, allowing drive slide 257 to engage handle 44 when motor operator is closed.

As motor operator 25 is pivoted about hinge 255 into engagement with operating handle 44, plate 259 will contact trip arm 260, causing it to rotate in a counter clockwise direction as shown in FIG. 16, which cause trip arm 260 to disengage from secondary latch 138, thus permitting normal operation of circuit breaker 20 and motor operator 25 to resume.

While the invention has been described with reference to a preferred embodiment, it will be understood by those skilled in the art that various changes may be made and equivalents may be substituted for elements thereof without departing from the scope of the invention. For example, the trip lever may be mounted and configured to slide instead of rotate, and may engage an intermediary which then actuates the trip latch, rather than actuating the trip latch directly. These and other modifications would occur to the skilled artisan to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a first contact in contact with a second contact;

an operating handle movable between an on position, an off position, and a trip position;

an operator having a driver, said driver releasably engaged with said operating handle, said driver positions said operating handle to said on position, said off position, and said trip position;

an operating mechanism in operable communication with said operating handle, said operating mechanism arranged to separate said first contact and said second contact;

a trip lever in operable communication with said operating mechanism, said trip lever arranged to trip said operating mechanism when said operator is removed from said circuit breaker, said operating handle moves to said trip position when said operating mechanism trips; and wherein said driver moves to a position corresponding with said trip position of said operating handle such that said driver and said operating handle are in alignment.

2. The circuit breaker of claim 1, said operator pivotably connected to said circuit breaker by a hinge.

3. The circuit breaker of claim 1, wherein said operator includes a plate, said plate contacts said trip lever causing said trip lever to reset when said operator engages said operating handle.

4. A circuit breaker comprising:

a first contact in contact with a second contact;

an operating handle movable between an on position, an off position, and a trip position;

an operator having a driver, said driver engaged with said operating handle, said driver positions said operating handle to said on position, said off position, and said trip position;

an operating mechanism in operable communication with said operating handle, said operating mechanism arranged to separate said first contact and said second contact;

means for tripping said operating mechanism when said operator is removed from said circuit breaker, said tripping of said operating mechanism causes said operating handle to move to a predetermined trip position; and wherein said driver moves to a position corresponding with said trip position of said operating handle such that said driver and said operating handle are in alignment.

5. The circuit breaker of claim 1, said operator pivotably connected to said circuit breaker by a hinge.

6. The circuit breaker of claim 1, wherein said operator includes a plate, said plate contacts said trip lever causing said trip lever to reset when said operator engages said operating handle.

7. A method of ensuring proper engagement between a driver of an operator with an operating handle of a circuit breaker, said method comprising:

causing said circuit breaker to trip when said operator is disengaged from said operating handle, said tripping of said circuit breaker causes said operating handle to move to a predetermined trip position; and moving said driver to a position corresponding with said trip position of said operating handle such that said driver and said operating handle are in alignment.

8. The method of claim 7 wherein said causing comprises:

biasing a trip lever under the influence of a trip spring;

releasing said trip lever to contact a trip latch of said circuit breaker when said operator is moved away from said operating handle; and tripping said circuit breaker in response to said trip lever contacting said trip latch.

* * * * *